US007357281B2

(12) United States Patent
Colucci

(10) Patent No.: US 7,357,281 B2
(45) Date of Patent: Apr. 15, 2008

(54) CLOTHES HANGER WITH PANTS HOLDING DEVICE

(76) Inventor: Donald E Colucci, 800 Englewood Dr., Apt. 4, North Canton, OH (US) 44721

( * ) Notice: Subject to any disclaimer, the term of this patent is extended or adjusted under 35 U.S.C. 154(b) by 0 days.

(21) Appl. No.: 11/474,677

(22) Filed: Jun. 26, 2006

(65) Prior Publication Data

US 2007/0295770 A1 Dec. 27, 2007

(51) Int. Cl.
*A41D 27/22* (2006.01)

(52) U.S. Cl. ..... 223/85

(58) Field of Classification Search ..... 223/85–98; D6/315–328

See application file for complete search history.

(56) References Cited

U.S. PATENT DOCUMENTS

| | | | | |
|---|---|---|---|---|
| 1,458,114 | A * | 6/1923 | Sommer | 223/90 |
| 2,464,324 | A * | 3/1949 | Levin | 223/91 |
| 2,472,262 | A * | 6/1949 | Mullen | 223/89 |
| 5,040,707 | A | 8/1991 | Ayano et al. | |
| 5,562,237 | A | 10/1996 | Saliaris | |
| 6,102,261 | A | 8/2000 | Tsai | |
| 6,286,734 | B1 | 9/2001 | Schneider | |
| 2004/0262341 | A1* | 12/2004 | Petrou | 223/85 |
| 2005/0194412 | A1* | 9/2005 | Petrou | 223/95 |

* cited by examiner

*Primary Examiner*—Gary L. Welch
*Assistant Examiner*—Andrew W Sutton
(74) *Attorney, Agent, or Firm*—Paul E Milliken; Ray L Weber

(57) ABSTRACT

A clothes hanger having a pants holding device for holding one or more pairs of pants, the hanger having a hook and an upper member of inverted V shape extending across the width of the hanger and having its center attached to the bottom of the hook. A bottom member extends substantially horizontally for the width of the hanger and spaced below the upper member with its ends attached to the ends of the upper member. A vertical member extends between each end of the upper member and an adjacent end of the bottom member. At least one pair of horizontal fingers, has each finger attached to and extending inwardly from one of the vertical members, the fingers of each pair being in axial alignment with each other but being of such a length as to leave an open space between the inner ends of the fingers to aid in placing the pants legs over the fingers to retain the pants in suspension between the fingers and the bottom member.

12 Claims, 8 Drawing Sheets

CLOTHES HANGER WITH PANTS HOLDING DEVICE

FIELD OF THE INVENTION

This invention relates to a clothes hanger which may hold one or more pair of pants and in particular which can securely hold the pants without the need of spring biased gripping devices. The hanger can contain only a pants holding device or it can be combined with a portion for holding coats, shirts or other such upper garments.

BACKGROUND OF THE INVENTION

Many types of trouser holders have been devised over the years either alone or in combination with coat hangers for holding suits, for example, wherein a coat and one or more pair of pants may be held on the same hanger.

Many prior art trouser holders resort to spring biased clamping devices such as those show in U.S. Pat. No. 5,040,707 issued to Ayano et al. and U.S. Pat. No. 6,286,734 issued to Schneider.

U.S. Pat. No. 6,102,261 issued to Tsai shows a pants hanger which supports one or more pairs of pants without being intended to support coats or other types of garments. The Tsai patent uses a plurality of spring biased gripping arms which clamp a pair pants against a fixed arm.

U.S. Pat. No. 5,562,237 issued to Saliaris shows a molded trouser hanger in which resilient gripping bars are formed integrally on a lower leg portion and flex to allow trousers to be inserted between the leg and the gripping bars but with the bars maintaining some degree of pressure against the trousers after the trousers are inserted in position on the hanger.

All the above described patents rely on a clamping or gripping action to secure trousers on the hanger.

In many cloths hangers the pants are merely hung on the bottom bar of a hanger, however the pants may easily slip of the bar and fall on the floor.

OBJECTS OF THE INVENTION

It is an object of the present invention to provide a simplified trouser hanger which can be molded in a single piece and without relying of a clamping or gripping action of a spring biased mechanism or on resilient gripping arms or bars;

It is a further object to provide a trouser holding device which can be used alone or in combination with a clothes hanger with a portion for holding coats, shirts or other garments; and A still further object of the invention is to provide a trouser hanger which relies on the spatial relationship of a plurality of inwardly extending fingers in relation to a bottom bar member with the fingers and bar member causing bends in the trousers legs to create an increased frictional relationship between the trousers and the fingers and bar member to better retain the trousers on the hanger.

SUMMARY OF THE INVENTION

A clothes hanger with a pants holding device said clothes hanger comprising: a hook; an upper member extending across the width of the hanger and having the hook attached to the center thereof and extending upwardly therefrom, a bottom member extending substantially horizontally for the width of the hanger and spaced below the upper member, a pair of vertical members, with each vertical member extending between one end of the upper member and an adjacent end of the bottom member; at least one pair of horizontal fingers, with each finger attached to and extending inwardly from one of the vertical members, the fingers of each pair being in axial alignment with each other but being of such a length as to leave an open space between the inner ends of the fingers to aid in placing the pants legs over the fingers to retain the pants in suspension between the fingers and the bottom member.

BRIEF DESCRIPTION OF THE DRAWINGS

The above and other objects, features and other advantages of the present invention will be more clearly understood from the following detailed description taken in conjunction with the accompanying drawings in which.

DETAILED DESCRIPTION OF THE INVENTION

Figure 1:
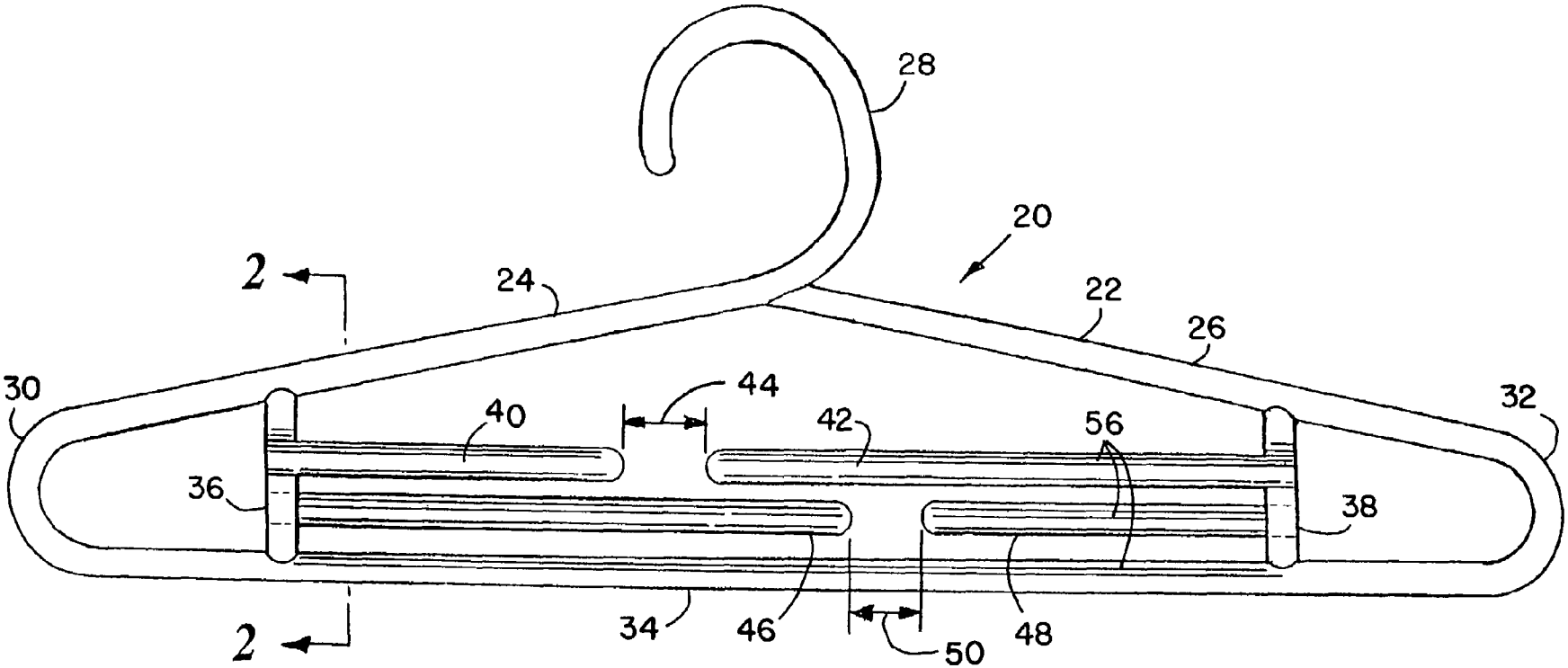
FIG. 1 is a front elevational view of one embodiment of a clothes hanger of the invention.
Figure 2:
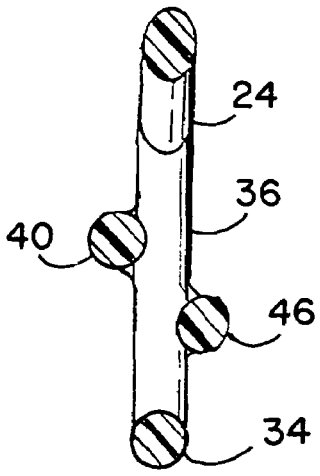
FIG. 2 is a cross-sectional view taken of 2-2 of FIG. 1.
Figure 5:
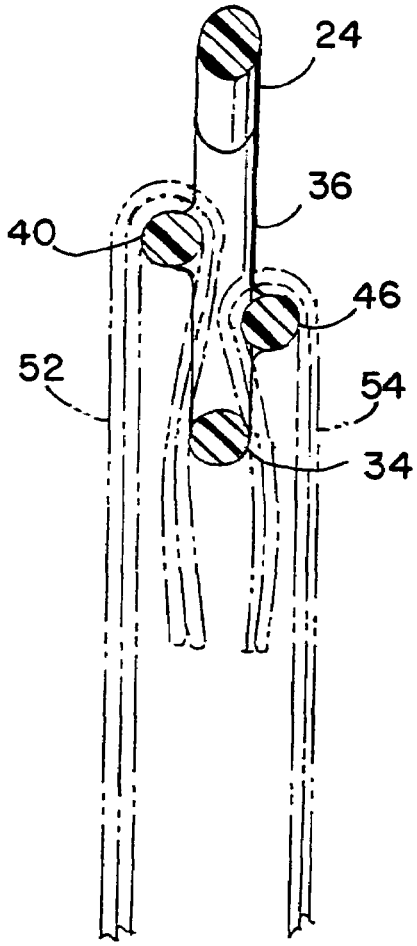
FIG. 5 is a cross-sectional view of the embodiment shown in FIG. 2 showing how that two pairs of trousers (shown in chain dotted lines) hang from an upper and lower pair of fingers.

Referring now to FIGS. 1, 2 and 5, a clothes hanger indicated generally by the numeral 20, has an upper component 22 having a first arm 24 joined to a second arm 26 at the center of the hanger 20 and being joined to a hook 28 and extending downwardly and outwardly therefrom forming an inverted V shape. The outer ends of the arms 24 and 26 respectively terminate in semi-circular end portions 30 and 32 which are connected to each end of a bottom bar 34 extending therebetween.

The arms 24 and 26, and the bottom bar 34 form a substantially triangular shape except for the rounded end portions 30 and 32.

A left vertical bridge member 36 extends between arm 24 and bar 34 near the outer ends thereof and a right vertical bridge member 38 extends between the arm 26 and bar 34 near their outer ends.

An upper pair of fingers is comprised of a left horizontal finger 40 which extends inwardly from the bridge member 36 and a right horizontal finger 42 which extends inwardly from the bridge member 38. The arms 40 and 42 are in axial alignment with each other and the arm 40 is shorter than the arm 42. The arms 40 and 42 terminate at a distance from each other leaving a gap 44 therebetween.

Similarly a lower pair of fingers 46 and 48 is comprised of a left horizontal finger 46 which extends inwardly from the bridge member 36 and a right horizontal finger 48 which extends inwardly from the bridge member 38. The arms 46 and 48 are in axial alignment with each other and the arm 48 is shorter than the arm 46. The arms 46 and 48 terminate at a distance from each other leaving a gap 50 therebetween.

It may be seen that the gaps 44 and 50 are offset from each other with the gap 44 being left of the center of the hanger and the gap 50 being right of the center. The purpose of the gaps is to make it easier to insert the trousers around one of the pairs of fingers as will be explained later.

In FIGS. 2 and 5, the finger 40 is offset to the left of the bottom bar 34 and the finger 46 is offset to the right of the bottom bar 34. This provides room for one pair of pants 52 and a second pair of pants 54 (shown in broken lines) to hang on the fingers 40 and 46 respectively while having the lower end of the pants legs to bear against the bottom bar 34 to provide friction for holding the pants in place.

It should be further mentioned that the fingers 40, 42, 46, and 48 as well as the bottom bar 34 may have some small horizontal ribs and grooves 56 or other textured area to increase the friction of the pants with the hanger parts when the pant legs are in contact with the fingers or bottom bar.

The hanger described above is preferably molded from plastic by injection molding or any other suitable molding technique as an integral unit with no assembly of individual parts required.

Figure 3:
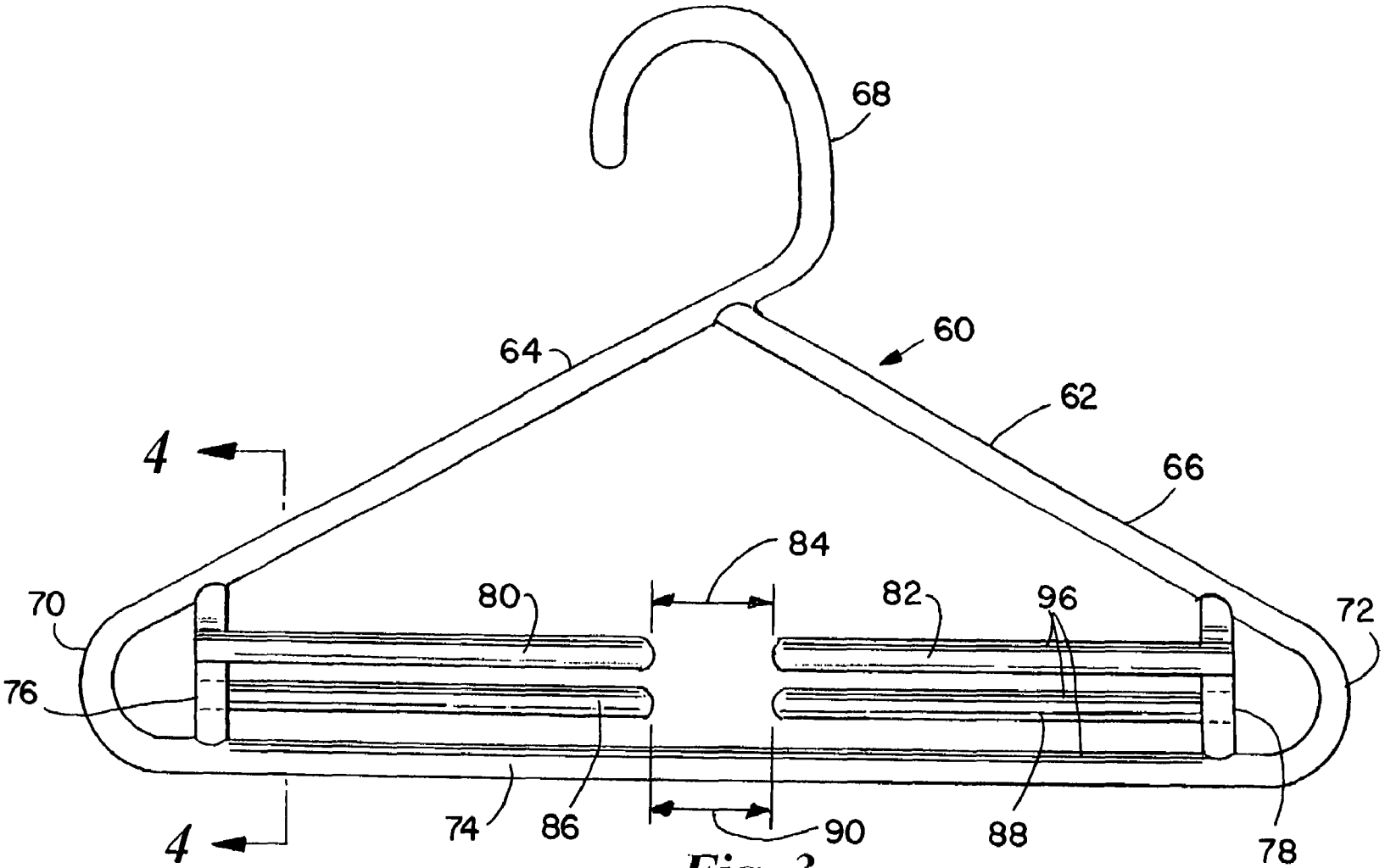
FIG. 3 is a front elevational view of another embodiment of a clothes hanger of the invention.
Figure 4:
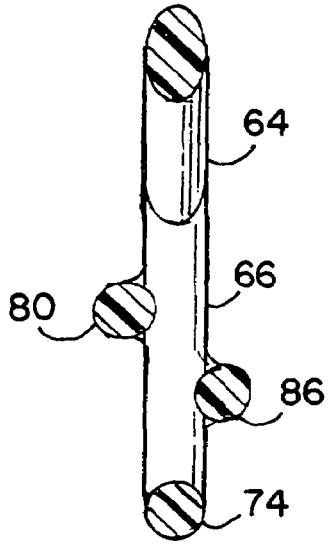
FIG. 4 is a cross-sectional view taken on 4-4 of FIG. 3.
Figure 6:
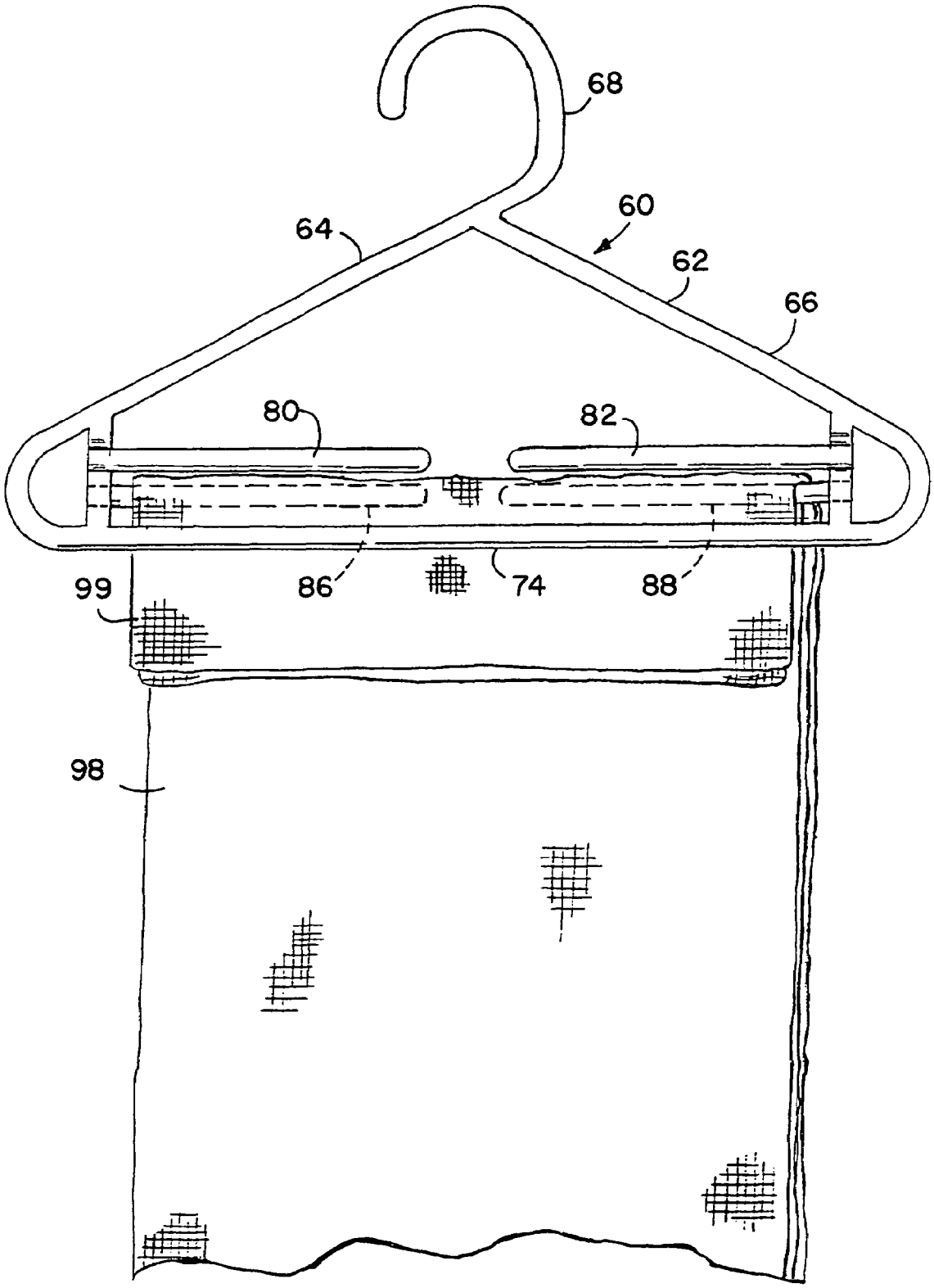
FIG. 6 is a front elevational view of the embodiment shown in FIG. 3 with a pair of pants hanging from a lower pair of fingers.

Referring now to FIGS. 3, 4 and 6 a slightly different embodiment is show in which the hanger is not as wide as that shown in FIG. 1. The hanger in FIG. 1 has sufficient width to hold a coat or other garment in addition to holding pants.

The hanger in FIG. 3 is designed primarily for hanging one or two pairs of pants and therefore need not be as wide as the hanger in FIG. 1.

Referring now to FIGS. 3 and 4, a clothes hanger indicated generally by the numeral 60, has an upper component 62 having a first arm 64 joined to a second arm 66 at the center of the hanger 60 and being joined to a hook 68 and extending downwardly and outwardly therefrom forming an inverted V shape. The outer ends of the arms 64 and 66 respectively terminate in semi-circular end portions 70 and 72 which are connected to each end of a bottom bar 74 extending therebetween.

The arms 64 and 66, and the bottom bar 74 form a substantially triangular shape except for the rounded end portions 70 and 72.

A left vertical bridge member 76 extends between arm 64 and bar 74 near the outer ends thereof and a right vertical bridge member 78 extends between the arm 66 and bar 74 near their outer ends.

An upper pair of fingers consist of a left horizontal finger 80 which extends inwardly from the bridge member 76 and a right horizontal finger 92 which extends inwardly from the bridge member 78. The fingers 80 and 82 are in axial alignment with each other and are of equal length. The fingers 80 and 82 terminate at a distance from each other leaving a gap 84 therebetween.

Similarly a lower pair of fingers consist of a left horizontal finger 86 which extends inwardly from the bridge member 76 and a right horizontal finger 88 which extends inwardly from the bridge member 78. The fingers 86 and 88 are in axial alignment with each other and are of equal length. The fingers 86 and 88 terminate at a distance from each other leaving a gap 90 therebetween.

It may be seen that the gaps 84 and 90 are of equal width and are vertically aligned with each other at the center of the hanger 60. The purpose of the gaps is to make it easier to insert the trousers around one of the pairs of fingers as will be explained later.

In FIG. 4, the finger 80 is offset to the left of the bottom bar 74 and the finger 86 is offset to the right of the bottom bar 74. This provides room for one pair of pants similar to the pants (shown in broken lines) on FIG. 5 to hang on the fingers 80 and 86 respectively with lower end of the pant legs to bearing ainst the bottom bar 74 to provide friction for holding the pants in place.

Similar to the embodiment shown in FIG. 1, the fingers 80, 82, 86, and 88 as well as the bottom bar 74 may have some small horizontal ribs and grooves 96 or other textured area to increase the friction of the pants with the hanger parts when the pant legs are in contact with the fingers or bottom bar.

FIG. 6 shows the hanger 60 of FIG. 3 with a pair of pants 98 hung on the lower fingers 86 and 88 and with the lower end 99 of the pants 98 lying between the fingers 86 and 88 and the bottom bar 74 and extending for a short distance below the bottom bar 74.

Figure 7:
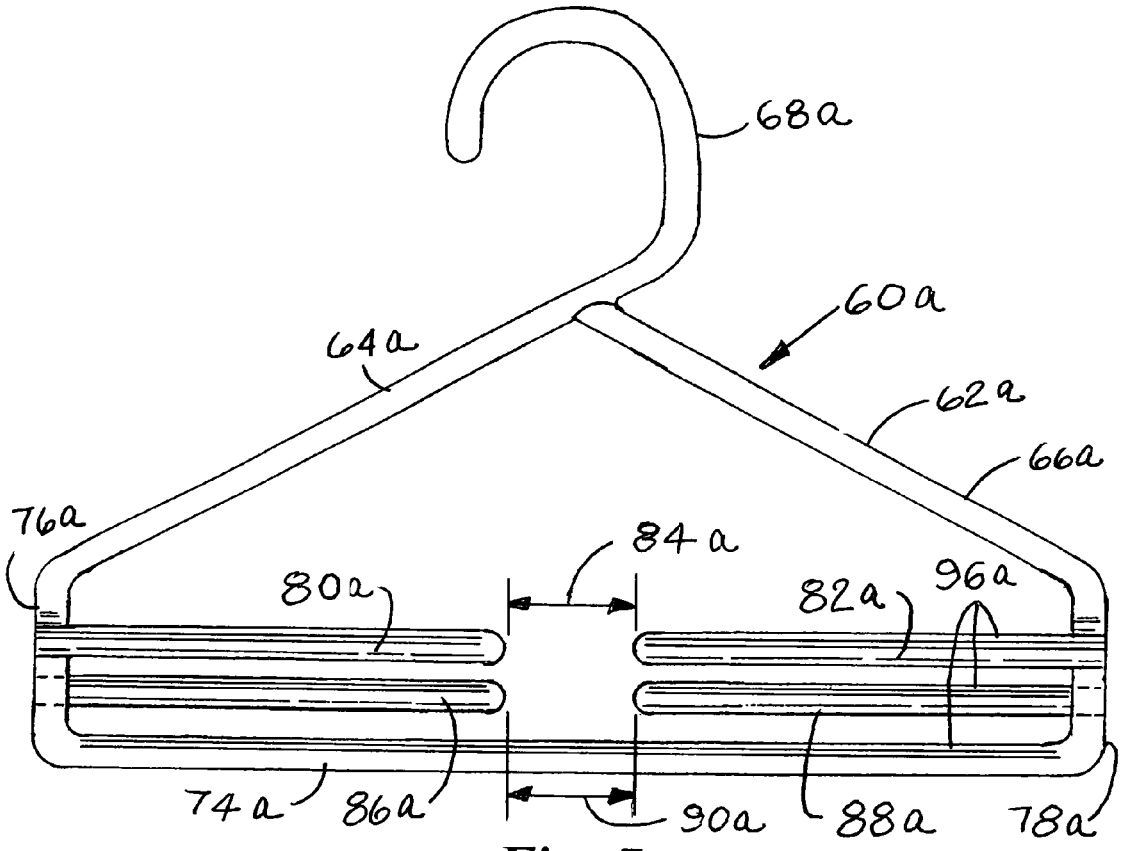
FIG. 7 is a front elevational view of another embodiment similar to that shown in FIG. 3 but having truncated ends.

The embodiment of hanger shown in FIG. 7 is substantial identical to that in FIG. 3 except that it does not have the semicircular end portions 70 and 78. Because of the similarity of these two embodiments, they have been assigned similar numerals except that the numerals in FIG. 7 are followed by an "a". The description relating to FIG. 3 applies equally to FIG. 7 so for brevity will not be repeated since the two embodiments are identical except for the hanger of FIG. 7 having truncated ends.

Figure 8:
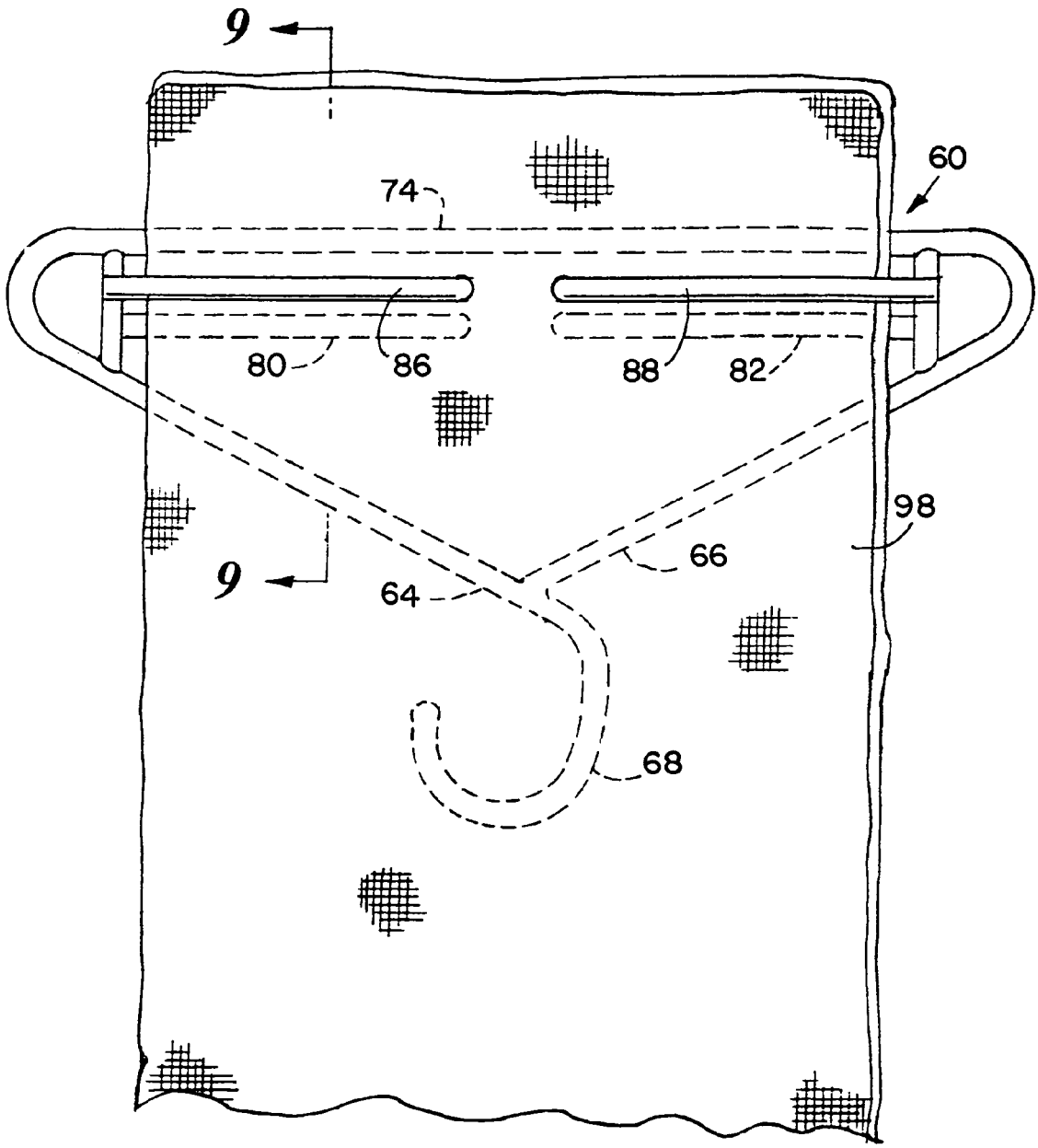
FIG. 8 is the embodiment shown in FIG. 3 but with the clothes hanger turned upside down to aid in inserting the pants between a pair of fingers and the remainder of the hanger.
Figure 9:
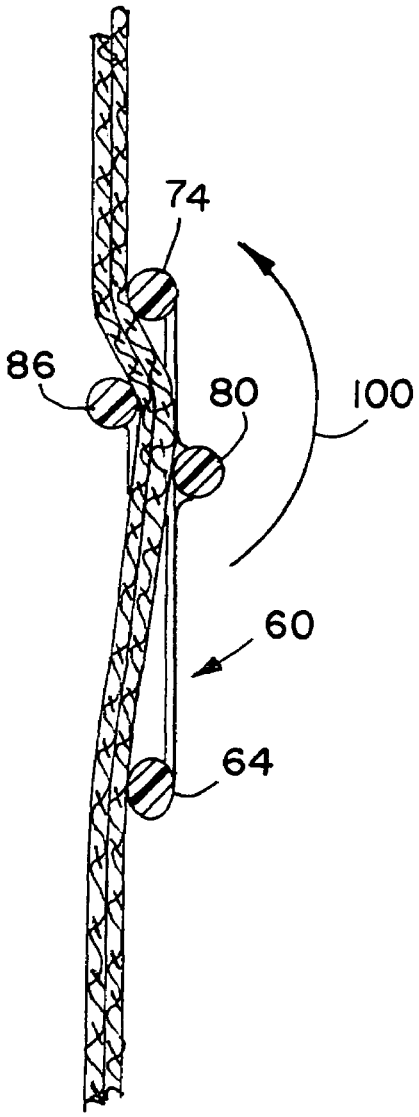
FIG. 9 is a cross-sectional view taken on line 9-9 of FIG. 8.
Figure 10:
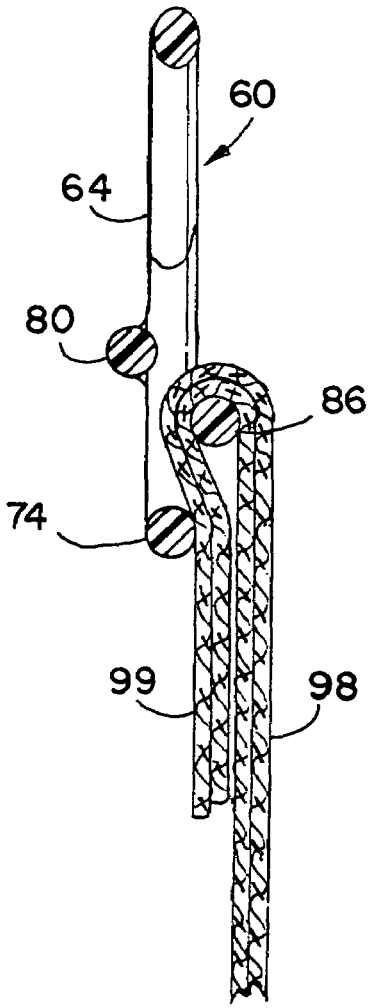
FIG. 10 is a cross-sectional view similar to FIG. 9 but with the hanger turned upright to allow the pants to hand down from the hanger.
Figure 11:
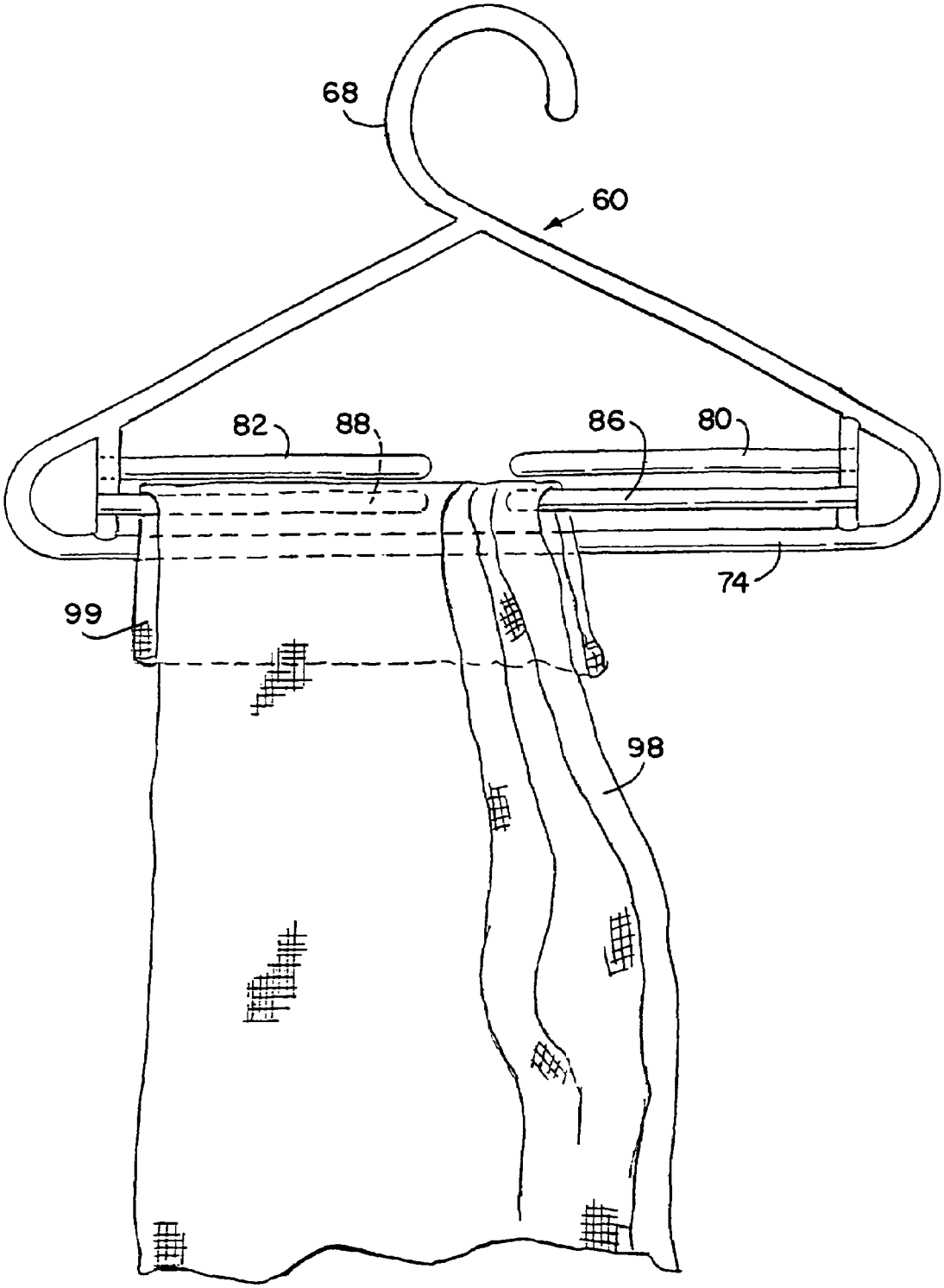
FIG. 11 is a front elevation view of the embodiment of FIG. 3 but with the pants partially inserted while the hanger is held in the upright position.

With regard to the three embodiments described in FIGS. 1-7, there are two methods of inserting pants on such hangers. The first method is shown in FIGS. 8-10 and the second method is shown in FIG. 11. The embodiment of FIG. 3 has been chosen to illustrate these two methods of hanging pants on the hanger, however the same method can also be used for the other two embodiments.

Referring now to FIGS. 8-10, one method of hanging pants on the hanger 68 is to first invert the hanger 20 with the hook 68 hanging down or if holding with the hook facing towards the person inserting the pants on the hanger.

FIGS. 8 and 9 shows the hanger 60 inverted with a pair of pants 98 inserted behind the fingers 86 and 88 and in front of the bar 74 and fingers 80 and 82. With the hanger and pants as shown in FIG. 8 the hanger 60 is then turned upright by rotating it upward as show by the arrow 100 in FIG. 9.

FIG. 10 shows the hanger after it has been turned upright with the pants 98 hanging downwardly therefrom and the lower end of the pant legs bearing against the bottom bar 74 to create friction to prevent the pants from sliding off the bar 86.

FIG. 11 shows a second method of inserting the pants 98 on the hanger 60 in which the hanger is held upright while the pants are being placed in position on the hanger. In FIG. 11 the hanger has the opposite side facing forward from that shown in FIG. 8. The lower end portion 99 of the pants 98 has been folded over and the left side of the pant legs have been slid on to the lower finger 88 through the gap between finger 86 and 88. The pant legs have been moved to the left so that a right portion of the pant legs are starting to be slid through the gap between fingers 86 and 88 and onto the lower finger 86. When the pants 98 have been slid full in place on fingers 86 and 88, and if the hanger is turned around to the position shown in FIG. 6, the pants 98 will hang just the same as those in FIG. 6.

The width of the gap between the inner ends of the fingers on any of the embodiments shown herein can be approximately 1¼±" however it could vary somewhat. The gap should be wide enough the enable the pants to pass through the gap onto the fingers but not so wide that it does not adequately support the pants near the center of the hanger.

Likewise the spacing between the upper and lower fingers and the bottom bar should be large enough to accept the varying thicknesses of pant legs of various materials but the fingers and bottom bar should be close enough to create added friction between the pant legs and the hanger parts. The spacing between the above mentioned parts could be approximately in the range of ⅛" to 3/16±".

Various modifications can be made in the embodiments shown herein without departing from the scope of the invention.

What is claimed is:

1. A unitary molded clothes hanger with a pants holding device said cloths hanger comprising:

a hook;

an upper component having a first and second arm extending downwardly and outwardly from the bottom of the hook and having outer ends;

a crosspiece between the ends of said arms;

a pair of vertical bridge members with each bridge member extending between one of the arms and the crosspiece adjacent an end of one of the arms;

at least two pairs of substantially rigid horizontal fingers, with each finger attached to and extending inwardly from one of the bridge members, and wherein each pair of fingers is offset both vertically and horizontally from each other and from the cross piece;

the fingers of each pair being in axial alignment with each other and having an open space between the inner ends of the fingers to aid in placing the pants legs over the fingers to retain the pants in suspension in frictional engagement between the fingers and the crosspiece, and wherein, due to the horizontal offset between the fingers and the crosspiece, none of the fingers lies in a direct vertical plane extending through the crosspiece so that after the pants are draped over each pair of fingers the bottom end of the pant legs are urged against the crosspiece to aid in the retention of the pant legs from sliding off the fingers.

2. the clothes hanger of claim 1 wherein an outer end of each arm merges into one of the ends of the crosspiece through an arcuate portion.

3. the clothes hanger of claim 1 wherein the arms of the upper component extend downwardly from the bottom of the hook at an inclined angle and form a substantially triangular shape with the cross piece.

4. A unitary molded clothes hanger with a pants holding device said cloths hanger comprising:

a hook;

an upper member extending across the width of the hanger and having the hook attached to the center thereof and extending upwardly therefrom;

a bottom member extending substantially horizontally for the width of the hanger and spaced below the upper member;

a pair of vertical members, with each vertical member extending between one end of the upper member and an adjacent end of the bottom member; and at least two pairs of substantially rigid horizontal fingers, with each finger attached to and extending inwardly from one of the vertical members, and wherein each pair of fingers is offset both vertically and horizontally from each other and from the bottom member;

the fingers of each pair being in axial alignment with each other and having an open space between the inner ends of the fingers to aid in placing the pants legs over the fingers to retain the pants in suspension in frictional engagement between the fingers and the bottom member, and wherein, due to the horizontal offset between the fingers and the bottom member, none of the fingers lies in a direct vertical plane extending through the crosspiece so that after the pants are draped over each pair of fingers the bottom end of the pant legs are urged against the bottom member to aid in the retention of the pant legs from sliding off the fingers.

5. the clothes hanger of claim 4 wherein each outer end of the upper portion merges into one of the ends of the bottom member through an arcuate portion.

6. the clothes hanger of claim 4 wherein the upper member is in the form of an inverted V with each side of the V extending downwardly from the bottom of the hook at an inclined angle and forming a substantially triangular shape with the bottom member.

7. the clothes hanger of claim 4 wherein at least the finger members are of round cross section.

8. the cloths hanger of claim 7 where the bottom member is of round cross section.

9. the clothes hanger of claim 8 wherein the fingers and the bottom member each have a plurality of horizontal grooves thereon to provide better frictional contact with pants hung thereon.

10. the clothes hanger of claim 4 wherein the vertical members are at the outermost ends of both the upper member and the bottom member.

11. the clothes hanger of claim 4 wherein one of the fingers of each pair is longer that the other finger so that the space between the fingers is off center from the distance between the vertical members.

12. the clothes hanger of claim 4 wherein both the fingers of each pair are of equal length so that the space between the fingers is centered on the distance between the vertical members.

* * * * *